United States Patent [19]

Sawada et al.

[11] Patent Number: 4,602,251

[45] Date of Patent: Jul. 22, 1986

[54] IMAGE DISPLAY SYSTEM FOR CONTROLLING THE SCROLL OF A PARTIAL IMAGE ON A DISPLAY SCREEN

[75] Inventors: Nobuo Sawada, Atsugi; Masatsugu Kidode; Hidenori Shinoda, both of Yokohama, all of Japan

[73] Assignee: Tokyo Shibaura Denki Kabushiki Kaisha, Kawasaki, Japan

[21] Appl. No.: 526,158

[22] Filed: Aug. 24, 1983

[30] Foreign Application Priority Data

Aug. 30, 1982 [JP] Japan ..... 57-150254

[51] Int. Cl.[4] ..... G09G 1/06

[52] U.S. Cl. ..... 340/724; 340/750; 340/798; 340/799; 340/995

[58] Field of Search ..... 340/723, 724, 725, 798, 340/799, 995

[56] References Cited

U.S. PATENT DOCUMENTS

| | | | |
|---|---|---|---|
| 4,129,859 | 12/1978 | Iwamura et al. | 340/724 |
| 4,148,014 | 4/1979 | Burson | 340/724 |
| 4,360,876 | 11/1982 | Girault et al. | 340/995 |
| 4,484,192 | 11/1984 | Seitz et al. | 340/995 |
| 4,513,377 | 4/1985 | Hasebe et al. | 340/995 |

FOREIGN PATENT DOCUMENTS 55-59573 10/1978 Japan .

OTHER PUBLICATIONS

Hideyuki Tamura, "A Data Management System for Manipulating Large Images", pp. 45–54, Proceedings of the Workshop on Picture Data Description and Management Apr. 22–22, 1977, IEEE.

*Primary Examiner*—Gerald L. Brigance
*Assistant Examiner*—Jeffery A. Brier
*Attorney, Agent, or Firm*—Oblon, Fisher, Spivak, McClelland & Maier

[57] ABSTRACT

An image display system is disclosed which includes an image filing device to pre-store data on the entire area of a large sized image; a CRT unit to partially display this large sized image on its display screen at the same scale; and an image memory to temporarily store a partial image of the large sized image, that will be displayed on this CRT as well as its surrounding image. When display area scrolling is directed by a scroll direction input device, image information which is newly required due to the given scrolling operation is read out under the control of the CPU, and the unnecessary image information is replaced or written over by the new image information, with semi-realtime, in the memory area in which the image information which became useless due to the scrolling operation had been stored in the image memory. Thus, the display image area concerning the scroll and its surrounding image area always prepared in the image memory, thereby allowing for a smooth scrolling operation.

8 Claims, 17 Drawing Figures

IMAGE DISPLAY SYSTEM FOR CONTROLLING THE SCROLL OF A PARTIAL IMAGE ON A DISPLAY SCREEN

BACKGROUND OF THE INVENTION

The present invention relates to an image display system and, more particularly, to an image display system which displays part of a large sized image on a display unit and which displays a subimage area of the large sized image by scrolling the displayed area.

It is generally difficult to simultaneously and accurately display a large sized image, such as the image of an entire imagery, over a wide range indicating the surface profile of the earth to be transmitted from an artificial satellite on an ordinary display monitor device such as a cathode-ray tube (CRT) having a limited display area, a limited horizontal scanning line number and limited resolution. Therefore, it is commonly considered that different partial image areas of a large sized image are displayed respectively, by using a plurality of display monitor units, and the entire image is conveniently and finally obtained by combining these partial images. However, the overall constitution of such an image display system would be undesirable complicated.

As a general method of solving such a problem, a partial image of the large sized image is displayed on the CRT display, and by moving the screen, i.e., by scrolling this partial image, a desired partial image area of the large sized image may be displayed. However, in the prior art, the image signal in the area which has been once dislocated from an image memory such as a refresh memory for storing the image information corresponding to the partial image to be displayed on the CRT will have immediately disappeared. In other words, once the partial image in the image to be displayed on the CRT has been out of the display area and has disappeared from the image memory by the scrolling operation, it is difficult to immediately recall this vanished image area. The use of a memory with large capacity allows the image area which has disappeared from the CRT display to remain stored in the image memory, thereby preventing this image area information from disappearing from the image memory. However, an increase in the capacity of the image memory causes a reduction in the readout speed of memory information. Thus, the scroll speed will be reduced, resulting in prevention of the prompt display of a desired partial image on the CRT display. Therefore, according to the prior-art image display system, it is extremely difficult to effectively scroll the display-enabling area of the display in the large sized image at a higher rate of speed in any desired direction.

SUMMARY OF THE INVENTION

It is an object of the present invention to provide a new and improved image display system which can promptly and smoothly scroll a display area on the display unit to a given extent, in any direction, to display a desired partial image of a large sized image.

According to the present invention, to accomplish the above object, an image display system is provided, which comprises: a first memory device for stably storing data on the entire area of an original image; a display device which has a predetermined limited display screen and which partially displays the original image on the display screen; a second memory device provided between the first memory device and the display device, for temporarily storing first image information consisting of second image information corresponding to a partial image of the original image to be actually displayed on the screen of the display device and third image information corresponding to a surrounding image included in a predetermined surrounding area of the partial image in the original image; a scroll direction input device to be operated manually by an operator, for producing an electrical scroll direction command signal to specify the relative movement of a display area of the original image on the display screen, for only an arbitrary shift amount, over the entire area of the original image and in any direction; and a control device which is electrically connected to the scroll direction input device and the first and second memory devices. The control device performs scroll control in such a manner as to (i) newly read out, from said first memory device, fourth image information other than the first image information which will be lacking due to the scrolling of the display area in the second memory device, (ii) eliminate from the second memory device fifth image information which will be surplus, due to the scrolling of the display area in the second memory device, and which is included among the first image information, and (iii) store the fourth image information in place of the fifth image information in the memory address in which the fifth image information has been stored in the second memory device.

BRIEF DESCRIPTION OF THE DRAWINGS

The present invention may be best understood with reference to the accompanying drawings, in which.

DETAILED DESCRIPTION OF THE PREFERRED EMBODIMENT

Figure 1:
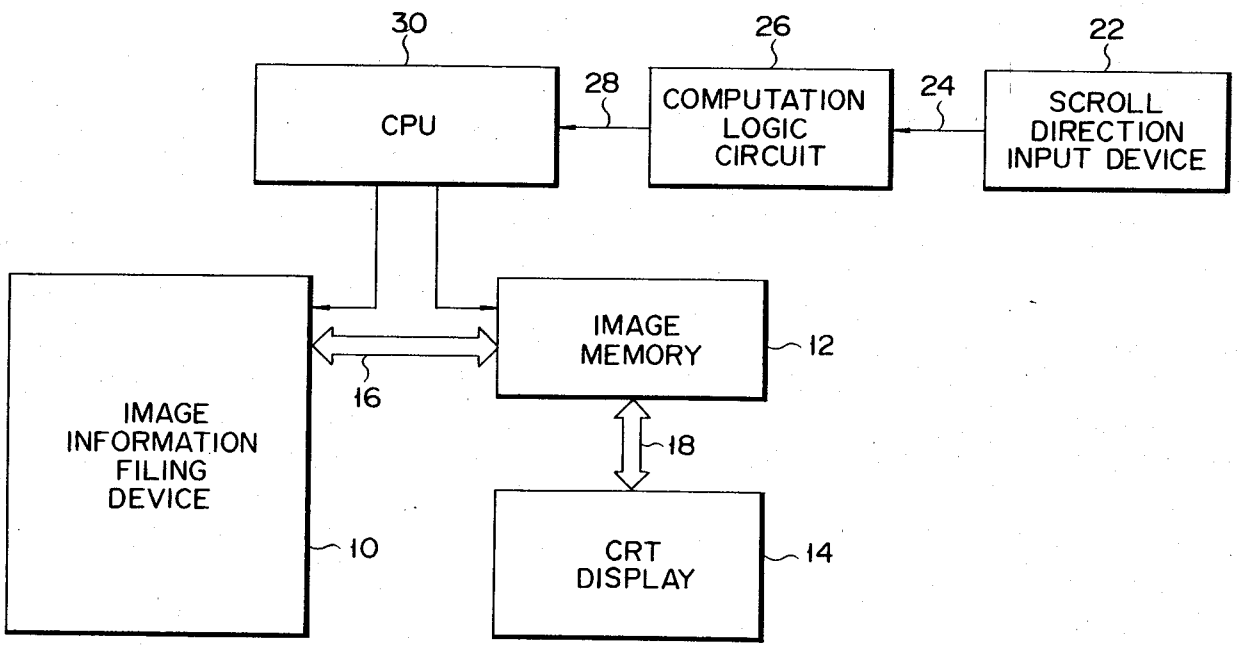
FIG. 1 is a block diagram showing the entire structure of an image display system according to an embodiment of the present invention.

FIG. 1 schematically illustrates the overall constitution of an image display system, according to an embodiment of the present invention, which partially displays on a display monitor device (such as a CRT) an original image of a wide-range image (referred to as a "large sized image" hereinafter), such as a surface imagery of the earth, which is scanned and transmitted by an artificial satellite orbiting the earth. The large sized image information is stored in a large scale random-access image information filing device 10 such as a magnetic disk device, an optical disk device or the like. This filing device 10 divides the large sized image into predetermined image area units and stores them in each of a plurality of image areas divided. In this image filing device 10, each of the image areas to be divided is scanned in two directions of the row direction (X-direction) and the column direction (Y-direction) of itself. The image scanned in the X-direction and the image scanned in the Y-direction, which correspond to one image area to be divided, are simultaneously stored in different memory areas of the filing device 10.

Figure 2:
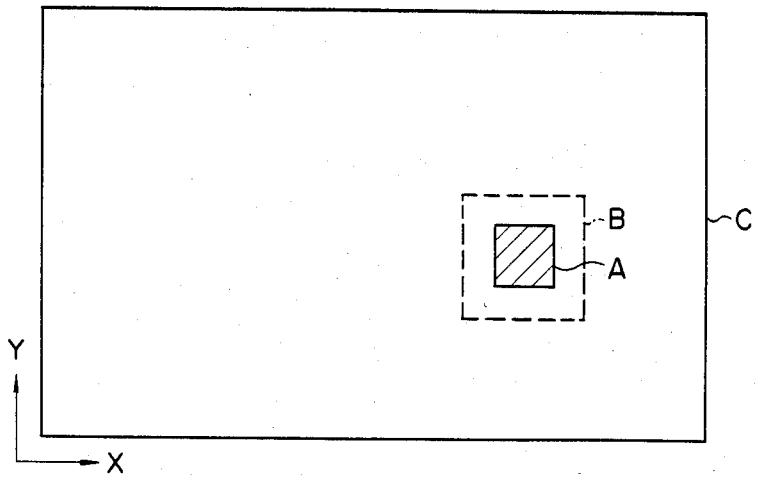
FIG. 2 is a diagram schematically illustrating the relative sizes of a large sized image area to be stored in a filing device, an image area to be stored in an image memory and the display screen of a display unit, according to the embodiment of FIG. 1.

An image memory (random-access memory) 12 is connected to a CRT display device 14. This memory 12 receives partial image information on the large sized image which is to be read out from the filing device 10 through a data bus 16, and serves as a refresh memory of the CRT display 14 through a data bus 18. FIG. 2 schematically illustrates the mutual size relationships of the memory area of the memory 12, a large sized image to be stored in the recording medium of the filing device 10, and a display area of the CRT display 14. In FIG. 2 reference character A indicates a display area of the CRT display 14, while characters B and C respectively represent a memory area of the image memory 12 and a memory area of the large sized image stored in the recording medium of the filing device 10. It should be noted that the memory area B of the memory 12 is so set as to be larger than the display area A on the same scale, having, for example, about four times the area of display area A. Therefore, the image area B, which is equivalent to the sum of the partial image to be displayed on the CRT 14 and its surrounding image, is read out from the large sized image C stored in the filing device 10 and is stored temporarily in the image memory 12. Then, the partial image A in a narrow spatial range included in the image 12 is displayed on the CRT 14.

A scroll direction input device 22 (e.g., a joy stick with a lever adapted for pivotal movement, or a track ball, etc.) is provided for manual operation by an operator, to indicate the scroll of the display screen for an arbitrary shift amount in any direction, including up and down, and right and left directions of the large sized image C. A display screen movement data (generally called a scroll data by those skilled in the art) 24 is generated from the scroll direction input device 22 and then supplied to a computation logic circuit 26. This circuit 26 vector-decomposes the moving direction and the shift amount of the display area A (refer to FIG. 2) for the image C, in the X and Y-directions and on the basis of the display screen movement data 24, and makes the respective computations. A computation results data 28 in the circuit 26 is transferred to a central processing unit (CPU) 30. The CPU 30 performs computations required in determining the coordinates for the display scroll, on the basis of the data 28, thereby controlling the components 10, 12, 14 in such a manner as to suitably execute the readout of the image information from the filing device 10, the transfer and storage of this readout image information to the image memory 12, and the ultimate display on the CRT 14. Under the control of this CPU 30, new partial image information on the entire image C which is read out from the filing device 10 and is newly required due to the scroll, is additionally stored in the partial memory area in which the image information (which became useless in the memory area of the image memory 12 due to the scrolling of the display area A) had been stored. The memory 12 includes a partial image of the entire image C (corresponding to the display area A) and its surrounding image. Such a series of scroll controls in the CPU 30 are continuously and repeatedly carried out, as long as the scroll direction input device 22 is being operated by the operator. Thus, the display image on the CRT display 14 successively moves in response to the manual scroll command given by the operator to the device 22. To further clarify this situation, the virtual display window to be specified by the CRT display area A is freely moved for only an arbitrary distance in any direction on the large sized image C which has been set, varying the direction and distance every time it moves. Therefore, the operator can visually confirm a desired image portion in the overall image C on the CRT 14.

The display image's continuous movement, i.e., the execution technique of the scroll, which is a unique technique of the present invention, will later be described in detail.

Figure 3A:
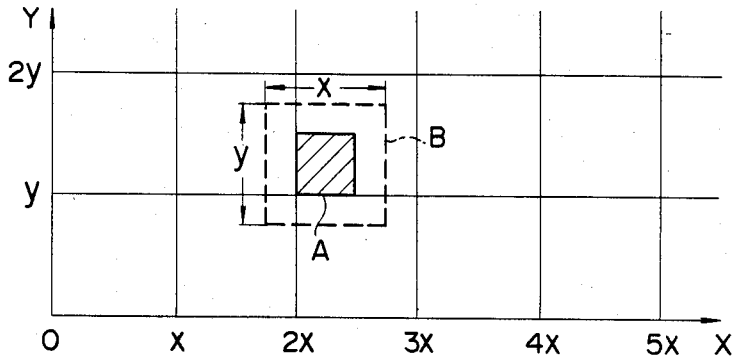
FIG. 3A is a schematic diagram illustrating in further detail the relationship between the image memory area and the large sized image divided into a plurality of unit image areas.

In one embodiment shown in FIG. 1, the large sized image C is divided into a plurality of partial images $C_{ij}$ ($i=1, 2, 3, \ldots, j=1, 2, 3, \ldots$) using unit lengths x and y (wherein, $x=y$, for example) in the X-Y coordinates when it is stored in the filing device 10, as schematically illustrated in FIG. 3A. On the other hand, the memory capacity of the image memory 12 is so set that the memory area B of this memory 12 is identical to that of one of the unit partial images $C_{ij}$ and is set to the size which is four times larger (in area) than the display area A of the CRT 14. The display area A (the portion which was hatched in FIG. 3A, for differentiation) is located at the center of the image memory area B (indicated by the broken lines in FIG. 3A). Consequently, this image memory 12 may store both a partial image of the image C corresponding to the display area A which is $x/2 \times y/2$ in size, and its surrounding image (having an image area about three times larger in area than area A).

Figure 3B:
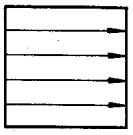
FIGS. 3B and 3C are diagrams showing the scanning images in the X and Y directions of each unit image area, respectively.
Figure 3C:
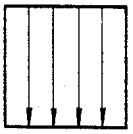

When each unit partial image $C_{ij}$ with a size equivalent to the divisional area which was set as described above is stored in the filing device 10, it is scanned in the X and Y-directions, respectively. Hence, two unit partial images $C_{ij(X)}$ and $C_{ij(Y)}$ are generated in the X and Y-directions, as shown in FIGS. 3B and 3C. These two kinds of partial images $C_{ij(X)}$ and $C_{ij(Y)}$ of each of the unit images $C_{ij}$, along with the position data for the entire image C, are doubly stored at predetermined memory addresses in the filing device 10, respectively. The position data includes the data to be used when retrieving the partial images $C_{ij}$, each of which consists of X and Y-images $C_{ij(X)}$ and $C_{ij(Y)}$, from the large sized image C stored in the filing device 10 in accordance with a predetermined retrieval algorithm.

Figure 4:
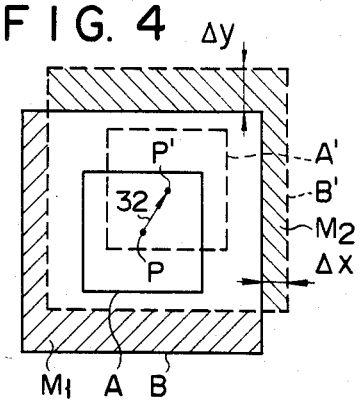
FIG. 4 is a diagram illustrating the moving mode of the large sized image in the image memory area for the unit image with respect to the screen scroll.

When the center of the image area A to be displayed on the CRT 14 is moved or scrolled from one point $P(x_1, y_1)$ to another point $P'(x_2, y_2)$ on the large sized image C as indicated by a vector 32 in FIG. 4 during the minute time interval $t_1$ and $t_2$ and in response to the scroll direction input device 22 to be manually operated by the operator, the present display area A moves to the position indicated by A' for only ($\Delta x$, $\Delta y$) (wherein, $\Delta x = x_2 - x_1$, and $\Delta y = y_2 - y_1$) on the full image area C. In this case, the shift amount (vector value) of the display area may be represented by a primary combination of the movement in the X-direction and the movement in the Y-direction, as shown in the following expression using i and j (each of which represents the unit vector in the X and Y-axis directions).

$$(\Delta x, \Delta j) = \Delta x \cdot i + \Delta y \cdot j$$

It should be noted here that, in situations wherein the image area to be displayed on the CRT display 14 moves as described above, the memory area B of the image memory 12, including the display area A and its surrounding image, also moves to the position indicated by B' for only ($\Delta x$, $\Delta y$), as shown in FIG. 4. Therefore, in the image memory 12, a portion (indicated by $M_1$ in FIG. 4) of the surrounding image area (included in image area B) of the display area A is deleted during the minute scroll time interval $\Delta t$. At the same time, in the image memory 12, the image area indicated by $M_2$ in FIG. 4 is newly added due to the scroll. The image areas $M_1$ and $M_2$ occupy the same memory capacity of the image memory 12. Thus, the CPU 30 performs the scroll control during the time interval $\Delta t$ in such a manner as to (i) read out only the image area portion (corresponding to $M_2$) of the image C which was newly required by the scroll from the filing device 10 and (ii) store this in the memory area (corresponding to $M_1$) in which the image area portion (which became useless by the scroll) of the image memory 12 has been stored. In this case, in accordance with scroll direction the CPU 30 determines which image of the unit image $C_{ij}$, whether X-image $C_{ij(X)}$ or Y-image $C_{ij(Y)}$, which includes the new image area portion to be added, should be used to make the memory address access speed faster, thereby realizing a high-speed memory rewrite. In other words, CPU 30 performs the scroll control in such a way that the required image information of the Y-image $C_{ij(Y)}$ is used for the X-direction scroll component in the image area to be newly added, and, on the contrary, the required image information of the X-image $C_{ij(X)}$ is used for the Y-direction scroll component, thereby rewriting the unnecessary image information of the image memory 12. The partial rewriting operation of the image information in the image memory 12 as described above is processed with a semi-real-time every time a scroll command is made by the operator using the scroll direction input device 22. In this way, the partial image area B' of the large sized image C including its surrounding image area around the display image A' after scroll may be always prepared in the image memory 12 in accordance with the scroll command by the operator. The CRT 14 then receives and displays image information stored in the display area A' read out from the memory 12.

Figure 5A:
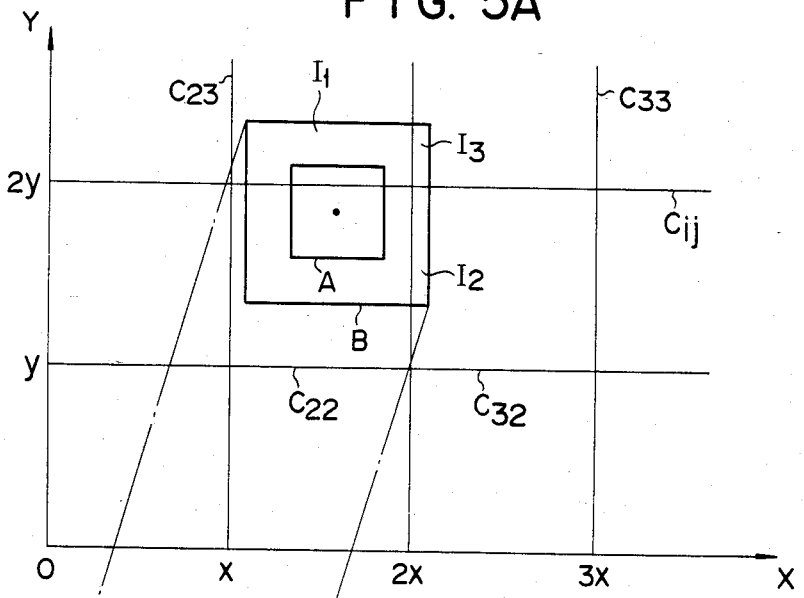
FIGS. 5A to 5C are diagrams illustrating the mutual relationships between the respective coordinates of the large sized image, the image memory area and the display screen.
Figure 5B:
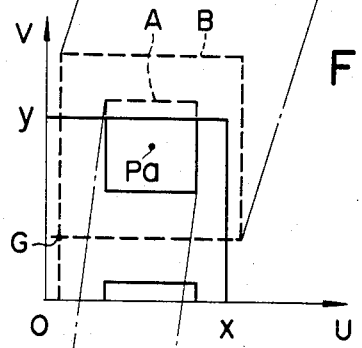
Figure 5C:
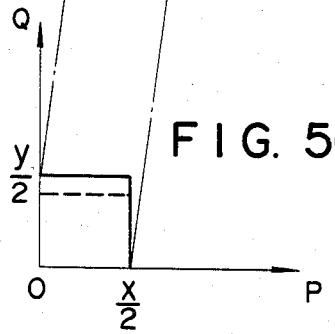
Figure 8:
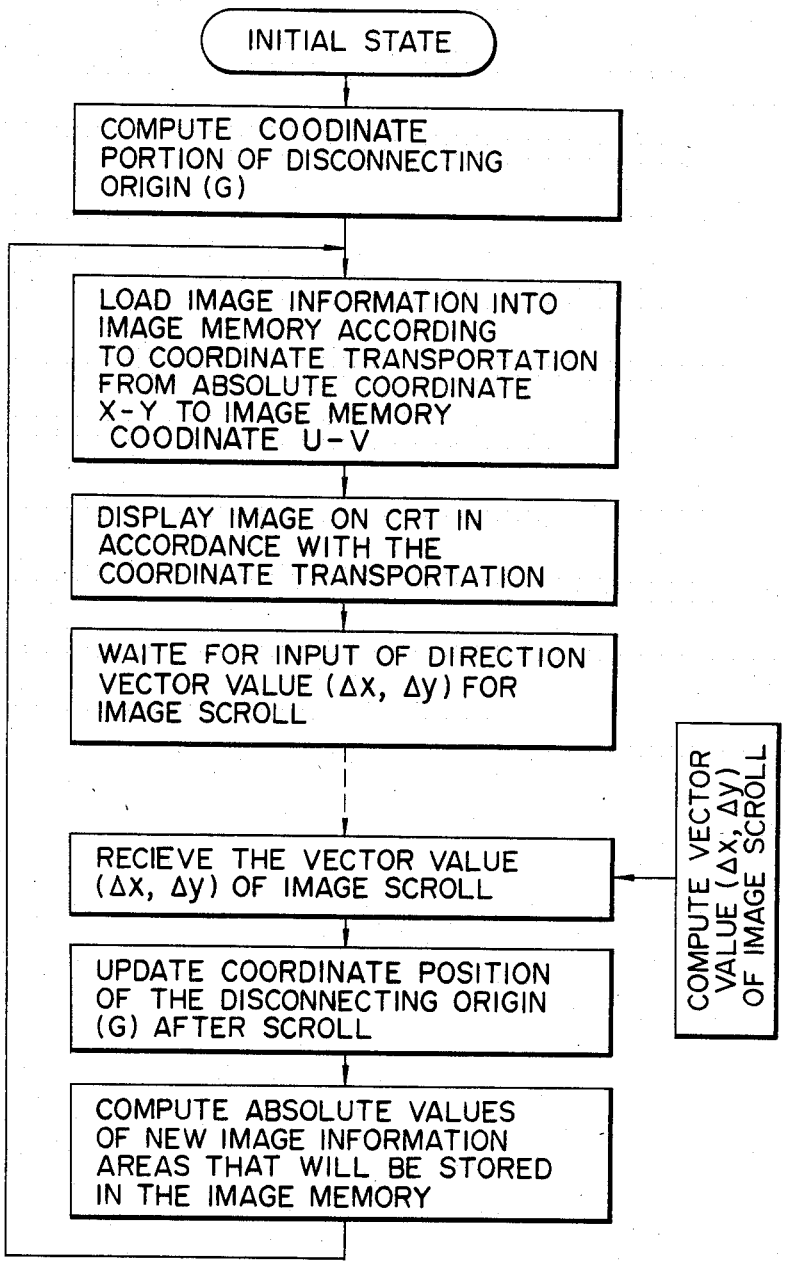
FIG. 8 is a flowchart showing the computation procedure of coordinates, which are to be carried out by the CPU for scroll control.

The technique used in computing the coordinate data of memory space, through which the CPU 30 reads out the image information from the filing device 10 and rewrites such information in the image memory 12, may now be described with reference to the flowchart of FIG. 8. FIGS. 5A to 5C respectively indicate the coordinates of the address spaces of the filing device 10, the image memory 12 and the CRT 14. The coordinate system of the memory space of the filing device 10 is, by definition, comprised of the absolute coordinates X-Y for the large sized image C. The coordinate system of the memory space of the image memory 12 is comprised of the coordinates U-V representative of the partial image area B which was read out from the filing device 10. The coordinates U-V are of the relative coordinate system to the coordinates X-Y and are computed using a projection of ($x \times y$) of the image partial area B as modulo x and y, respectively. The display area A of the CRT 14 is defined as coordinates P-Q. The coordinates P-Q are of the relative coordinates to the coordinates U-V and the pixel position displayed by this coordinate system P-Q is also similarly computed using a projection of ($x \times y$) of the partial area B as modulo x and y, respectively.

Now, at timing $t_a$, when the central point P of the display area A of the CRT display 14 is so specified as to be located at absolute coordinates ($x_a$, $y_a$), the absolute coordinates of the partial image area B of the large sized image C to be stored in the image memory 12 may be represented as:

$$\left\{ (X, Y): |X - x_a| \leqq \frac{x}{2}, \ |Y - y_a| \leqq \frac{y}{2} \right\} \tag{1}$$

For the absolute coordinate system X-Y of the partial image area B shown in this way, the coordinate system U-V of the image memory 12 may be defined as:

$$\left.\begin{array}{l} U = X(\text{mod } x) \\ V = Y(\text{mod } y) \\ \text{"mod" indicates "modulo"} \end{array}\right\} \tag{2}$$

While, the memory address space of the image memory 12 may be represented as follows:

$$\left.\begin{array}{l} 0 \leqq U \leqq x \\ 0 \leqq V \leqq y \end{array}\right\} \tag{3}$$

As shown in FIG. 5A, when the central point $P_a$ of the display area A does not coincide with the central point of the unit partial image $C_{ij}$ of the large sized image C, i.e., when the absolute coordinates ($x_a$, $y_a$) of the central point $P_a$ of the display area A do not satisfy the terms of the following expressions $$\left.\begin{array}{l} x_a = m \cdot x + \frac{x}{2} \\ y_a = n \cdot y + \frac{y}{2} \end{array}\right\} \tag{4}$$

(where, m, n=0, ±1, ±2, . . . ), a difference will occur between the memory address space prepared in the image memory 12 and the address space of which the mode has been transformed in the partial area B to be stored in this memory 12. In this case, the coordinates ($a_kx$, $a_ky$) of a cross point (hereinafter, typically referred to as a "disconnecting origin") G of the border lines, where the image information stored in the image memory 12 is being disconnected in the memory address space of the image 12, may be represented as:

$$\left.\begin{aligned} a_k x &= x_a + \frac{x}{2} \pmod{x} \\ a_k y &= y_a + \frac{y}{2} \pmod{y} \end{aligned}\right\} \quad (5)$$

Figure 6:
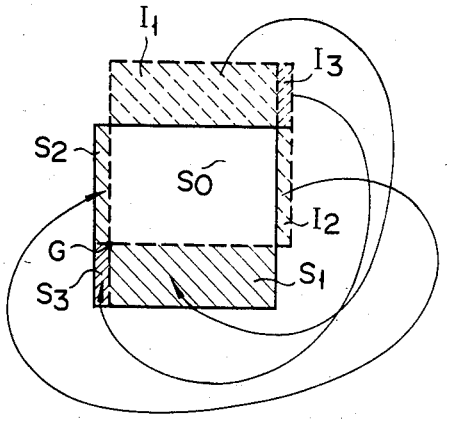
FIG. 6 is an explanatory diagram schematically illustrating by arrows the method of storing partial image information in the image memory.

In this way, to store the partial image area B which is out of the image memory address space in the image memory 12, dislocating image components $I_1$, $I_2$ and $I_3$ of the area B are respectively stored in memory spaces $S_1$, $S_2$ and $S_3$ determined by two disconnecting border lines which pass through the disconnecting origin G, as schematically illustrated in FIG. 6. Thus, a portion of the large sized image C corresponding to the first dislocating image $I_1$ of the image area B is stored in the first empty area $S_1$ of the image memory address space. Likewise, portions of the large sized image C responsive to second and third dislocating images $I_2$ and $I_3$ are respectively stored in second and third empty areas $S_2$ and $S_3$ of the image memory address space. As a result, i the image memory 12 with the coordinate system U-V specified in the mode of absolute coordinates X-Y, images $S_0$, $S_1$, $S_2$ and $S_3$ that will be individually and partially read out from four unit partial images among a plurality of unit partial images $C_{ij}$ of the large sized image C and stored on the image memory 12, are equivalently and successively stored during the image processing procedure.

As described above, the coordinate position ($u_d$, $v_d$) in coordinates U-V of the central point $P_a$ of the display image area A to be read out from the image memory 12 for storing the image information may be expressed as:

$$\left.\begin{aligned} u_d &= a_k x + \frac{x}{2} \pmod{x} \\ v_d &= a_k y + \frac{y}{2} \pmod{y} \end{aligned}\right\} \quad (6)$$

Therefore, the display image area A may be represented in coordinates U-V as follows:

$$\left\{ (u, v): |U - u_d| < \frac{x}{4}, \ |V - v_d| < \frac{y}{4} \right. \quad (7)$$

It should be noted here that the disconnecting origin G will never enter the display image area A.

Since the P-Q display coordinate system in the CRT display 14 is also defined by using absolute coordinates X-Y as modulo X and Y, respectively, in the manner described above, the relationship between the display coordinate system (P, Q) and the coordinate system (U, V) of the image memory 12 may be expressed as follows:

$$\left.\begin{aligned} U &= P - a_k x - \frac{x}{4} \pmod{x} \\ V &= Q - a_k y - \frac{y}{4} \pmod{y} \end{aligned}\right\} \quad (8)$$

The size of the display area coordinate system (P, Q) is defined as:

$$\left.\begin{aligned} 0 \leqq P \leqq \frac{x}{2} \\ 0 \leqq Q \leqq \frac{y}{2} \end{aligned}\right\} \quad (9)$$

The CPU 30 executes the coordinate transformation processing of the image memory 12 and CRT display area, using the above equations (8) and (9), thereby retrieving the image information included in area A from among the image information stored in the image memory 12, for display at the corresponding coordinate position on the CRT display 14.

Figure 7A:
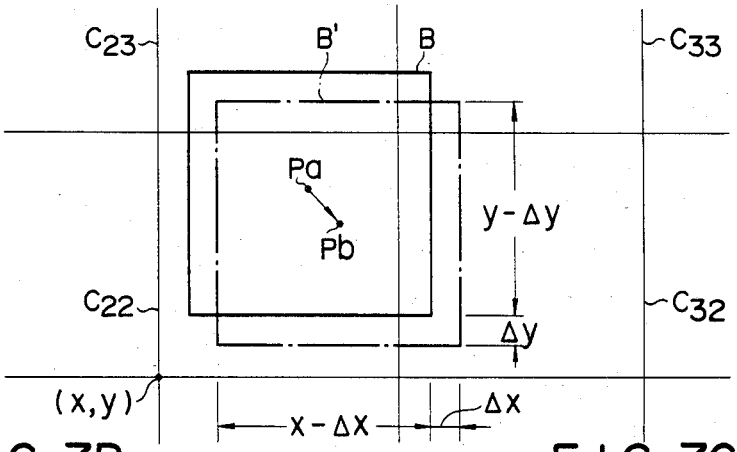
FIGS. 7A to 7F are respective diagrams visually illustrating the principal computation process of coordinates of the scroll control operation to be executed by a CPU upon screen scroll.
Figure 7B:
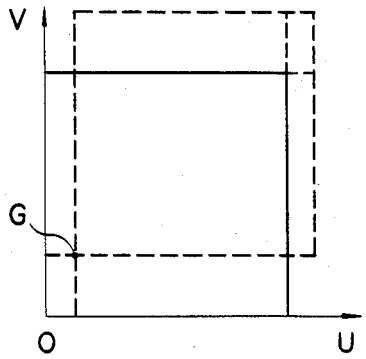
Figure 7C:
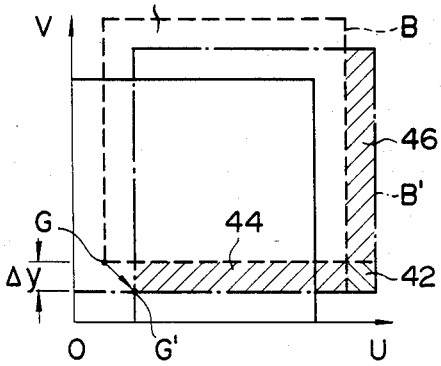

The case may now be considered wherein scrolling of the display image is made for ($\Delta x$, $\Delta y$) in a time interval $\Delta t$ between time points $t_a$ and $t_b$ according to the scroll command of the operator, as shown in FIG. 7A. In this case, the central point $P_b$ of the image area B′ to be stored in the image memory 12 may be ($x_a+\Delta x$, $y_a+\Delta y$), as shown in FIG. 7A, and its area frame will shift to the lower right position as indicated by the alternate long and short dashed line of FIG. 7A. Along with this scroll, the disconnecting origin is also moved from G to G′ by ($\Delta x$, $\Delta y$), as shown in FIGS. 7B and 7C.

When the image area B moves to position B′ due to the image scroll, the image information relative to the area indicated by a reference numeral 40 in the image memory 12 is eliminated. At the same time, the following image information (new image information that will be added to the memory 12) will be lacking in the image memory 12:

(i) a first image information 42 having an extent of $\Delta x \times \Delta y$, (ii) a second image information 44 having an extent of $(x-\Delta x)\times\Delta y$, (iii) a third image information 46 having an extent of $\Delta x \times (y-\Delta y)$.

At this time, the CPU 30 computes the coordinates of the image areas including these first to third image information 42, 44 and 46 on the basis of the mode with respect to the above-mentioned absolute coordinates X-Y. Then, the CPU 30 reads out the first to third image information 42, 44 and 46 from the filing device 10 according to this coordinate computation result and writes in empty memory addresses in the image memory 12. In this case, in the example shown in FIG. 7A, the central point $P_a$ ($x_a$, $y_a$) of the image memory area B before scroll is included in the unit partial image $C_{22}$ of the large sized image C. Therefore, the CPU 30 accesses the individual X-direction scanning images $C_{(x)}$ and Y-direction scanning images $C_{(Y)}$ of the unit partial image area $C_{22}$ and the areas $C_{32}$ and $C_{33}$ adjacent thereto i.e., images $C_{22(X)}$, $C_{22(Y)}$, $C_{32(X)}$, $C_{32(Y)}$, $C_{33(X)}$ and $C_{33(Y)}$). Then, the CPU 30 extracts the image information 42, 44 and 46 which will be newly required. In this case, for example, upon supply of the third image information (X-direction scroll component) 46 to the memory 12, it is possible to extract the third image information 46 from the large size image C at a higher speed by scanning and accessing the X-direction scanning images $C_{32(X)}$ and $C_{33(X)}$ of the unit image areas $C_{32}$ and $C_{33}$.

Figure 7D:
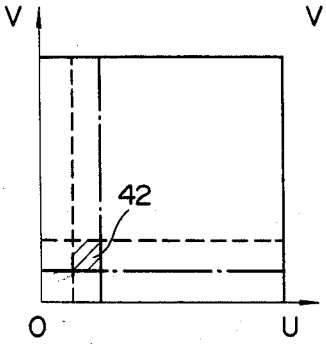
Figure 7E:
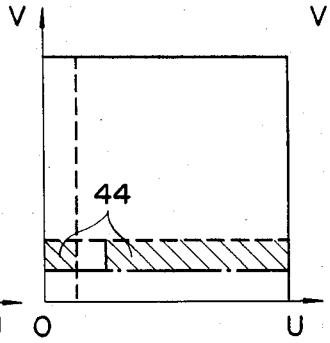
Figure 7F:
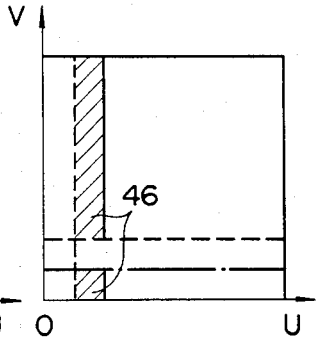

The first and third image information 42, 44 and 46, which have been newly extracted from the filing device 10 in the manner described above, are transferred through the data bus 16 to the image memory 12, under the control of the CPU 30, and are then stored in the memory address spaces which became empty due to the display scrolling, as shown in FIGS. 7D to 7F. In this way, the scroll operation conducted during the time interval $\Delta t$ between time points $t_a$ and $t_b$ is completed; and thereafter, operations similar to that described above are sequentially repeated whenever a scroll command is made by the operator.

According to the image display system of the present invention, which is constructed and operates in the manner described above, both a partial image of the large sized image to be displayed on the CRT display 14 and the ambient image thereof are prepared in the image memory 12. In the case of the scrolling of display screen, the CPU 30 performs screen scroll control at semi-realtime by the steps of reading out from the filing device 10 only the image information that will be newly required due to this scroll, and storing the readout image information at the empty memory address at which the useless image information (which became useless due to the scroll in the image memory 12) had been stored. Thus, even in continuing the scroll operation, it is possible to always store the present image being displayed on the CRT 14 and its surrounding image in the image memory 12. Therefore, it is possible to not only easily re-display on the CRT the image which had once disappeared from the CRT screen, but also to freely, continuously and smoothly scroll the CRT screen of the large sized image C for an arbitrary shift in any direction.

Furthermore, according to the present invention, when the large sized image C is divided into a plurality of unit image areas $C_{ij}$, the X-direction scanning image $C_{ij(X)}$ and Y-direction scanning image $C_{ij(Y)}$ are produced for each unit image area and stored doubly in the filing device 10. Thus, the new image information (42, 44, 46) to be supplied to the image memory 12 upon screen scrolling can be read out from the filing device 10 at a higher rate of speed. This is because, when desired image information is extracted from the filing device 10, two different X and Y-direction scanning images $C_{ij(X)}$ and $C_{ij(Y)}$ may be suitably selected and used. In other words, to search out desired image information from the filing device 10, a scanning image for allowing the scanning time to be shortened between the X and Y-direction scanning images $C_{ij(X)}$ and $C_{ij(Y)}$ may be selected, and it is possible to read out the desired image information in a short time by using this selected image. As a result, unlike a large scale storage device, such as a filing device or the like, which has only sequential one-dimensional address spaces and, accordingly, which has such a property that the memory access time becomes extremely slow in the access direction of the components which meet at right angles in the information having two-dimensional address spaces, such as an image or the like against the above-mentioned one-dimensional address spaces; according to the system of the present invention, it is possible to appropriately select the access direction of either the X or Y-direction to find out desired image information in the filing device 10. Therefore, the rewrite speed of the image information of the memory 12 due to scrolling can be enhanced.

Although the present invention has been shown and described with respect to a particular embodiment, various changes and modifications, which are obvious to a person skilled in the art to which this invention pertains, are deemed to lie within the spirit and scope of the invention. For example, although the scale of the image memory 12 has been described as being four times that of the display screen, any memories larger than the scale of the display screen may be used, and such memories are not particularly limited to a fixed scale. Nor is there a need to make the size of the division area equal to that of the partial area. It may also be possible to reduce the size of the division area in such a way as to make a sub-block, thereby performing data transmission by using this sub-block as a unit. In such a case, however an X image and a Y image may not be doubly prepared. In addition, an image memory with two stage constructions may be used, with one of these constructions being used as a refresh memory and the other being used as a buffer memory.

What is claimed is:

1. An image display system comprising:

(a) first memory means for storing the entire area of an original image representing a photographed real image in such a manner that image data of each of a plurality of unit image components uniformly divided from the original image is scanned along two different scanning directions to produce first and second image data trains with respect to each of the unit image components;

(b) display means having a limited display screen on which the original image is partially displayed;

(c) second memory means connected to said first memory means and directly connected to said display means so as to permit direct reception of image data read out from said first memory means, said second memory means temporarily storing certain image data containing display image data representing a partial image of the original image to be actually displayed on the display screen, and surrounding image data representing a surrounding image having a predetermined surrounding area around the partial image;

(d) scroll direction input means operated manually by an operator, for producing an electrical command signal to specify a desired scroll direction along which a display area on the display screen is shifted throughout the entire area of the original image; and (e) control means, connected to said scroll direction input means and said first and second memory means, for, when the display screen is scrolled in a designated direction, electrically updating the memory content of said second memory means by substituting new image data, which is read out from said first memory means and represents a lacking image component due to the scroll of the display area, of old image data, which will be surplus due to the scroll of said display area, said control means selecting, from the first and second image data trains, one image data train which at least partially includes said lacking image component due to the scroll and which has such a desired scanning direction as to reduce the readout operation time of said second memory means.

2. An image display system according to claim 1, wherein said first memory means stores the entire area of an original image in such a manner that image date of each of a plurality of unit image components uniformly divided from the original image is scanned along row and column directions to produce a first train of image data components aligned in the row direction and a second train of image data components aligned in the column direction with respect to each of the unit image components.

3. An image display means according to claim 1, wherein said unit image component is so set as to be larger than the area of said limited display screen of said display means.

4. An image display system according to claim 3, wherein said second memory means has a memory capacity corresponding to one unit image component.

5. An image display system according to claim 1, wherein said scroll direction input means produces said scroll direction command signal which continuously represents a display area scroll varying with according to the operator's desired processing; and said control means comprises a central processing unit for repeatedly excuting said scroll control to fully adhere to said continuous scroll directions.

6. An image display system according to claim 1, wherein said scroll direction input means produces said command signal which continuously represents a display area scroll varying with time according to the operator's desired processing; and said control means comprises a central processing unit for repeatedly excuting said scroll control to fully adhere to said continuous scroll directions.

7. An image display system according to claim 6, wherein said central processing unit performs coordinate transformation processing from a first coordinate system to a second coordinate system in such a manner as to define the memory area of said image filing device using said first coordinate system to acknowledge the positions of said plurality of unit images of said original image and define the memory address of said second memory means using said second coordinate system, and to compute the extent of said new image data to be read out from said image filing device using said first coordinates as a mode.

8. A method for scrolling the display area of a display device which partially displays a predetermined original image representing a photographed real image in a desired direction over the entire area of the original image, said method comprising the step of:

(a) uniformly dividing the original image into a plurality of unit images;

(b) respectively scanning each of the unit images in a first and second scanning direction to create first and second image data trains with respect to each unit image;

(c) filing in a data filing device the original image in such a way as to store the first and second image data trains with respect to each unit image in a correspondence relation;

(d) accessing and extracting, from said original image, a certain image data containing display image data representing partial image of the original image to be actually displayed on a display screen of said display device and surrounding image data representing a surrounding image having a predetermined surrounding area around the partial image;

(e) temporarily storing said certain image data in a image memory and supplying said display image data to said display device;

(f) newly reading out, when the display screen is scrolled in a designated direction, from said data filing device, new image data which represents a lacking image component due to the scroll of the display area, and selecting, from the first and second image data trains of a unit image at least partially including said lacking image component, one image data train which has such a desirable scanning direction as to reduce the readout operation time of said image memory; and (g) electrically updating the memory content of said image memory by said image data for corresponding old image data which will be surpus due to the scroll of said display area.

* * * * *